US006951155B2

(12) United States Patent
Hu

(10) Patent No.: US 6,951,155 B2
(45) Date of Patent: Oct. 4, 2005

(54) HOOK SCREW DRIVER

(76) Inventor: Bobby Hu, 8F, No. 536~1, Ta Chin Street, Taichung (TW)

( * ) Notice: Subject to any disclaimer, the term of this patent is extended or adjusted under 35 U.S.C. 154(b) by 18 days.

(21) Appl. No.: 10/335,771

(22) Filed: Jan. 2, 2003

(65) Prior Publication Data

US 2003/0196523 A1 Oct. 23, 2003

(30) Foreign Application Priority Data

Apr. 22, 2002 (TW) ..... 91205630 U

(51) Int. Cl.[7] ..... B25B 13/28

(52) U.S. Cl. ..... 81/111; 81/901; 294/99.2; 269/239

(58) Field of Search ..... 81/901, 487, 111–113, 81/318–324, 326, 327, 44; 294/99.2; 269/160, 269/161, 329

(56) References Cited

U.S. PATENT DOCUMENTS

| | | | | | |
|---|---|---|---|---|---|
| 300,317 | A | | 6/1884 | Grifith | |
| 308,356 | A | * | 11/1884 | Goodrich | 269/239 |
| 362,262 | A | * | 5/1887 | Farmer | 269/239 |
| 670,361 | A | | 3/1901 | Sather | |
| 693,406 | A | | 2/1902 | Kydd | |
| 841,472 | A | | 1/1907 | Vanderherchen | |
| 855,905 | A | | 6/1907 | Rhoads | |
| 1,403,978 | A | * | 1/1922 | Rulfs | 269/161 |
| 1,782,752 | A | * | 11/1930 | Weisler | 269/239 |
| 1,980,087 | A | | 11/1934 | Rast | |
| 2,642,105 | A | | 6/1953 | Alliano | |
| 4,275,621 | A | | 6/1981 | Mallott, Sr. | |
| 4,836,066 | A | | 6/1989 | Graham et al. | |
| 5,058,465 | A | | 10/1991 | Womack | |
| 5,335,569 | A | | 8/1994 | Rowley | |
| 5,964,132 | A | | 10/1999 | Chen | |
| 6,026,715 | A | * | 2/2000 | Hu | 81/901 |
| 6,085,617 | A | | 7/2000 | Hu | |
| 6,101,905 | A | | 8/2000 | Hu | |

FOREIGN PATENT DOCUMENTS

| | | |
|---|---|---|
| EP | 0974426 | 1/2000 |
| EP | 1110674 | 6/2001 |
| FR | 2678538 | 6/1981 |
| GB | 12045 | 5/1913 |
| GB | 1140722 | 1/1969 |
| GB | 2248793 | 4/1992 |
| JP | 2000061856 | 12/2000 |
| JP | 2001225276 | 8/2001 |
| TW | 364439 | 8/1998 |
| TW | 364440 | 9/1998 |

* cited by examiner

*Primary Examiner*—Debra S. Meislin
(74) *Attorney, Agent, or Firm*—Alan D. Kamrath; Nikolai & Mersereau, P.A.

(57) ABSTRACT

A hook screw driver includes a first body, a second body having a first end pivotally connected to a first end of the first body, and a tightening member. The tightening member extends along a direction substantially perpendicular to an extending direction of the first body and an extending direction of the second body. The tightening member is movable between a first position at which a second end of the first body is spaced from a second end of the second body and a second position at which the second end of the first body presses against the first end of the second body, thereby securely holding a hook portion of a hook screw placed between the second end of the first body and the second end of the second body.

16 Claims, 14 Drawing Sheets

HOOK SCREW DRIVER

BACKGROUND OF THE INVENTION

1. Field of the Invention

The present invention relates to a hook screw driver that reliably clamps a hook screw during operation.

2. Description of the Related Art

Taiwan Patent Publication No. 364439 discloses a hook screw driver comprising a body and two discs. Each of two ends of the body has a compartment for partially receiving a respective disc. The respective disc has a retaining section on each of two ends thereof, the retaining section having a plurality of spaced blocks that constitute a plurality of grooves for securely retaining a hook portion of a hook screw of a size that may be varied in a range. In use, the respective disc is removed from the respective compartment, the hook portion of the hook screw is placed in the proper retaining section, and the disc is then placed in the respective compartment. The hook portion of the hook screw is retained in place by the blocks. However, it was found that the retaining sections that suit to the hook screws manufactured by one manufacturer may not suit the hook screws manufactured by other. Further, it was found that the hook screw tended to sway such that the user had to remove it from the respective disc and put it back for several times during operation.

U.S. Pat. No. 6,026,715 discloses a hook screw driver having a holding section and an end section. The holding portion has a first part integral with the end section and a second part. Each part has an inner side that includes a compartment defined in a first end thereof. A soft holding member is received in the compartment and made of a highly deformable, highly frictional material for securely holding a hook portion of a hook screw. A second end of each part has a threading defined in an outer side thereof. A retainer ring with an inner threading is moved forward along a longitudinal direction to threadedly engage with the threading on each part after the hook portion of a hook screw is placed on one of the soft holding members. Thus, the hook portion of the hook screw is held by the hook screw driver. However, it was found that the retainer ring could not move forward to tightly clamp the hook portion of a hook screw having a relatively large thickness. Further, the threading on each part of the hook screw driver is exposed and is thus apt to wear as a result of impingement by other tools in a box in which the hook screw driver is received. Thus, the hook screw driver lost the clamping function. Further, the second part can be opened for receiving/removing the hook screw only when the retainer ring is completely disengaged from the threading on each part, which is inconvenient to the user.

SUMMARY OF THE INVENTION

An object of the present invention is to provide a hook screw driver that reliably clamps a hook screw during operation.

Another object of the present invention is to provide a hook screw drive that allows easy placement/removal of a hook portion of a hook screw during use.

A hook screw driver in accordance with the present invention includes a first body, a second body having a first end pivotally connected to a first end of the first body, and a tightening member. The tightening member extends along a direction substantially perpendicular to an extending direction of the first body and an extending direction of the second direction. The tightening member is movable between a first position at which a second end of the first body is spaced from a second end of the second body and a second position at which the second end of the first body presses against the first end of the second body, thereby securely holding a hook portion of a hook screw placed between the second end of the first body and the second end of the second body.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
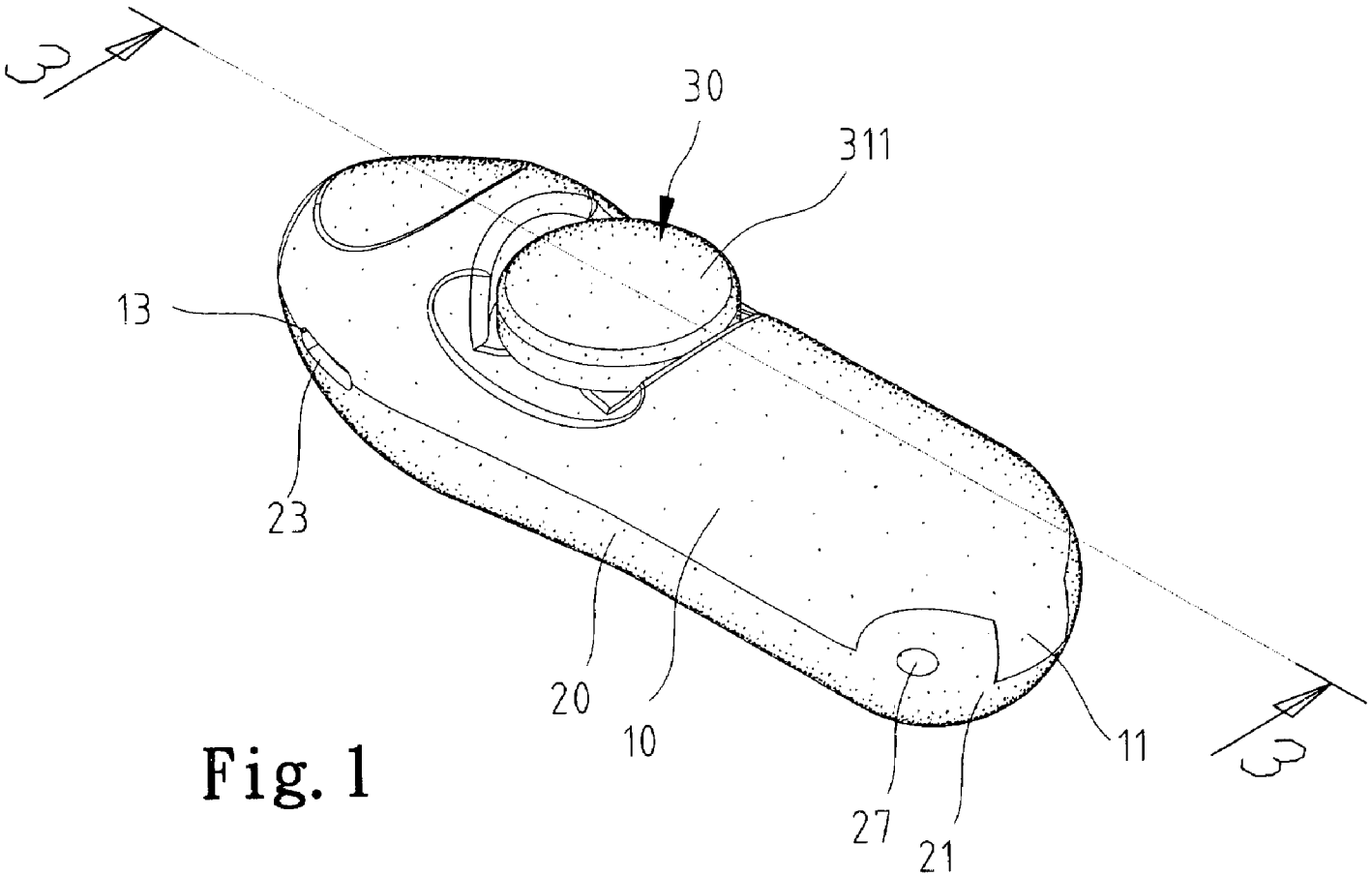
FIG. 1 is a perspective view of a first embodiment of a hook screw driver in accordance with the present invention.
Figure 2:
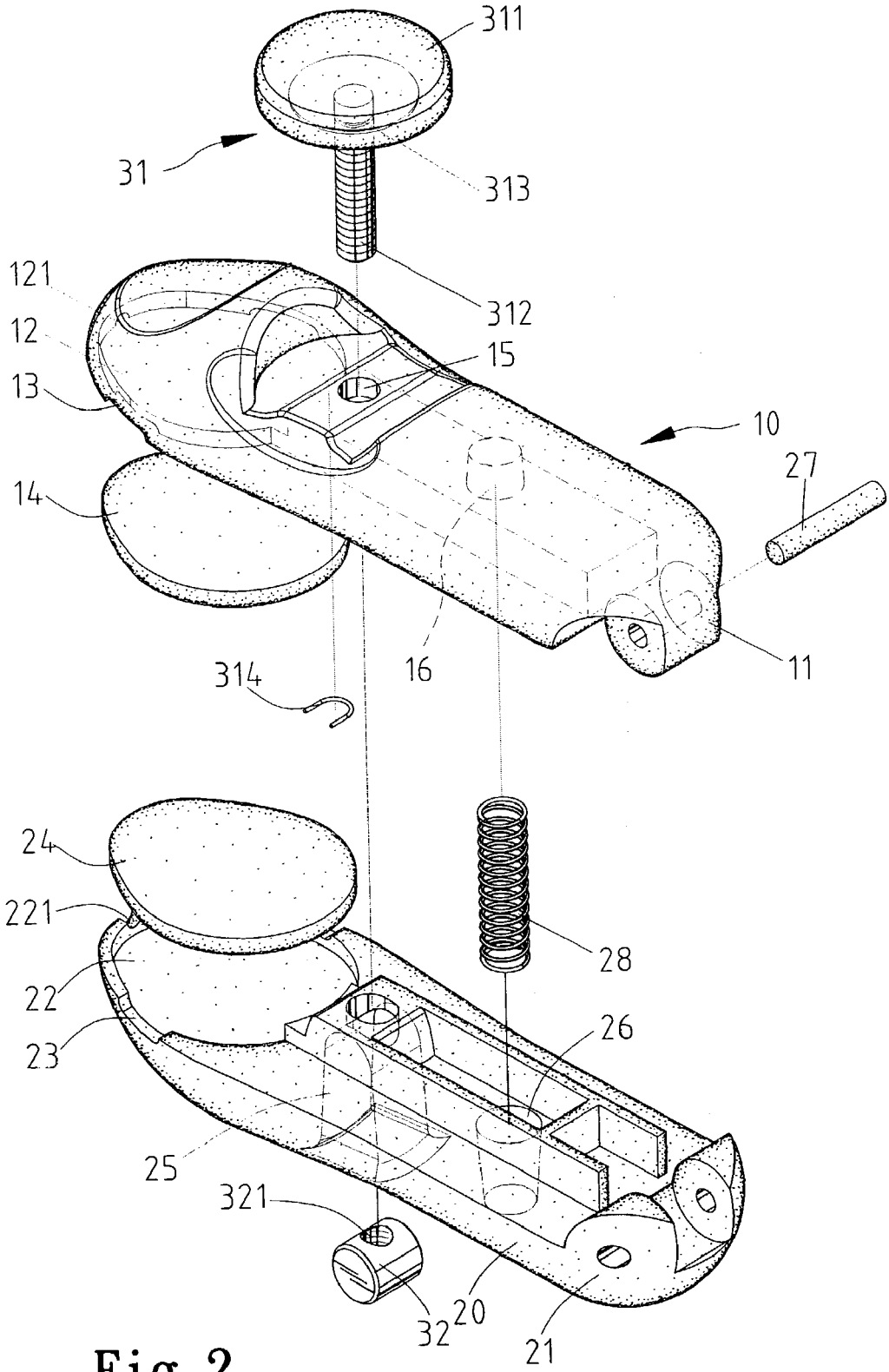
FIG. 2 is an exploded perspective view of the hook screw driver in FIG. 1.
Figure 3:
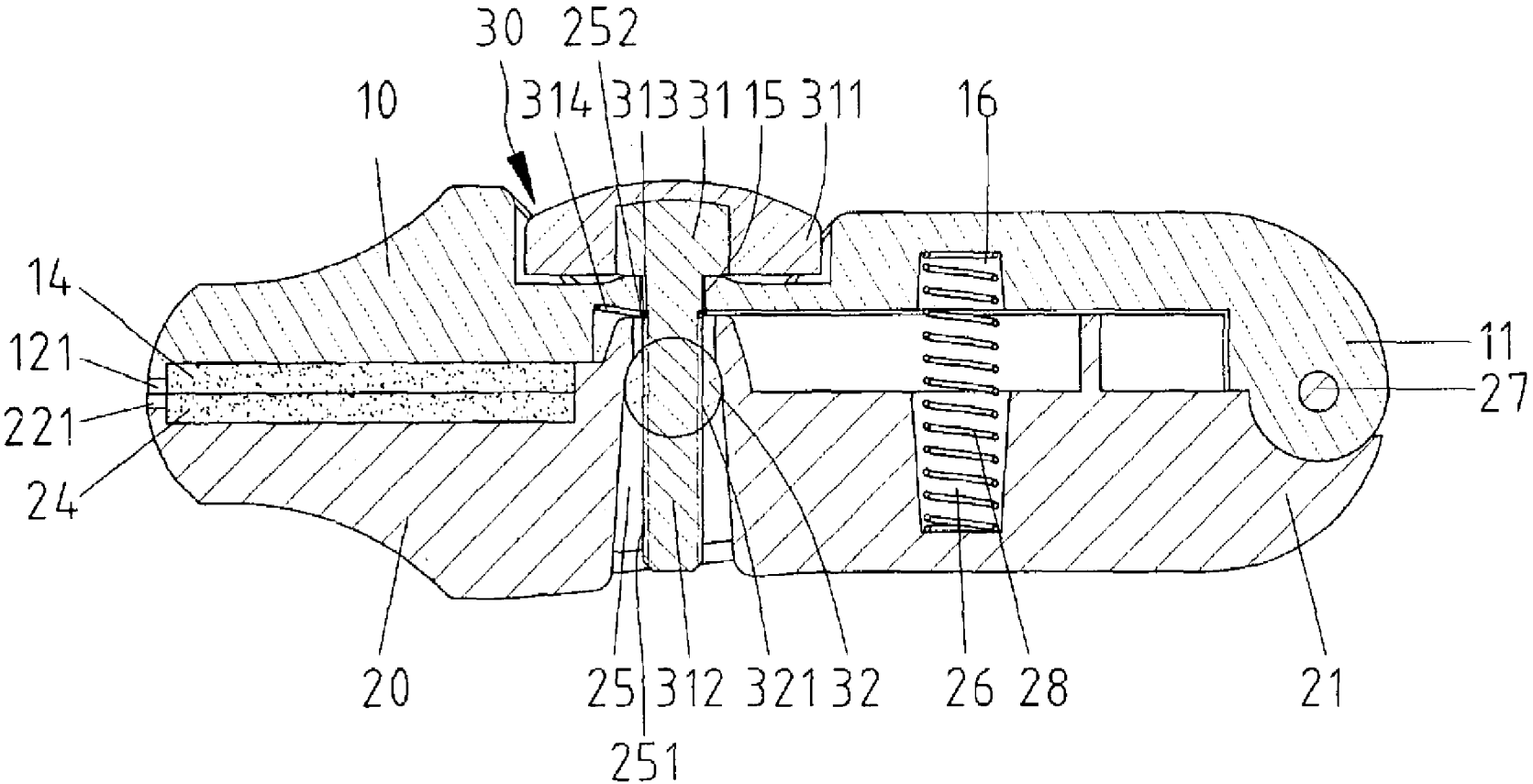
FIG. 3 is a sectional view taken along plane 3—3 in FIG. 1.

Referring to FIGS. 1 through 3, a first embodiment of a hook screw driver in accordance with the present invention generally comprises a first body 10, a second body 20, and a tightening member 30. The first body 10 has a pivotal section 11 on a first end thereof and a recessed portion 12 on an underside of a second end thereof. The recessed portion 12 of the first body 10 has a peripheral wall having a positioning hole 121 and a plurality of notches 13. A first holding member 14 is received in the recessed portion 12 of the first body 10 and is preferably made of highly deformable, highly frictional material. A through-hole 15 is defined in an intermediate portion of the first body 10 and extends in a direction substantially perpendicular to an extending direction of the first body 10. Further, a receptacle 16 is defined in an underside of the first body 10.

The second body 20 has a pivotal section 21 on a first end thereof and a recessed portion 22 on a top side of a second end thereof. The pivotal section 21 of the second body 20 is pivotally connected by a pin 27 to the pivotal section 11 of the first body 10. The recessed portion 22 of the second body 20 has a peripheral wall having a positioning hole 221 and a plurality of notches 23. A second holding member 24 is received in the recessed portion 22 of the second body 20 and is preferably made of highly deformable, highly frictional material. A through-hole 25 is defined in an intermediate portion of the second body 20 and extends in a direction substantially perpendicular to an extending direction of the second body 20. Further, a receptacle 26 is defined in the top side of the second body 20.

The through-hole 25 of the second body 20 is stepped and has a tapered portion 251 extending from an underside of the second body 20 and tapering upward. Further, the through-hole 25 of the second body 20 has a straight portion 252 of a diameter smaller than that of the tapered portion 251. An elastic element 28 has a first end received in the receptacle 16 of the first body 10 and a second end received in the receptacle 26 of the second body 20, thereby biasing the second end of the first body 10 away from the second end of the second body 20.

A tightening member 30 is extended through the through-hole 15 of the first body 10 and the through-hole 25 of the second body 20. In this embodiment, the tightening member 30 includes a threaded stem 312 and an end piece 311 securely attached to an upper end 31 of the threaded stem 312. A substantially U-shaped retaining member 314 is received in an annular groove 313 defined in the upper end 31 of the threaded stem 312 of the tightening member 30, with at least a section of the retaining member 314 abutting against the underside of the first body 10, thereby preventing the tightening member 30 from disengaging from the first body 10.

Further, a retaining member 32 is movably mounted in the tapered portion 251 of the through-hole 25 of the second body 20. The retaining member 32 is a substantially cylindrical member extending in a direction perpendicular to the extending direction of the tapered portion 251 of the through-hole 25 and the second body 20 and perpendicular to an extending direction of the threaded stem 312. The retaining member 32 is so sized that the retaining member 32 is movable along the extending direction of the tapered portion 251 of the through-hole 25 until it is stuck in a position shown in FIG. 3 such that it is not rotatably in the tapered portion 251 of the through-hole 25. Further, the retaining member 32 has a screw hole 321 through which the threaded stem 312 extends.

Figure 4:
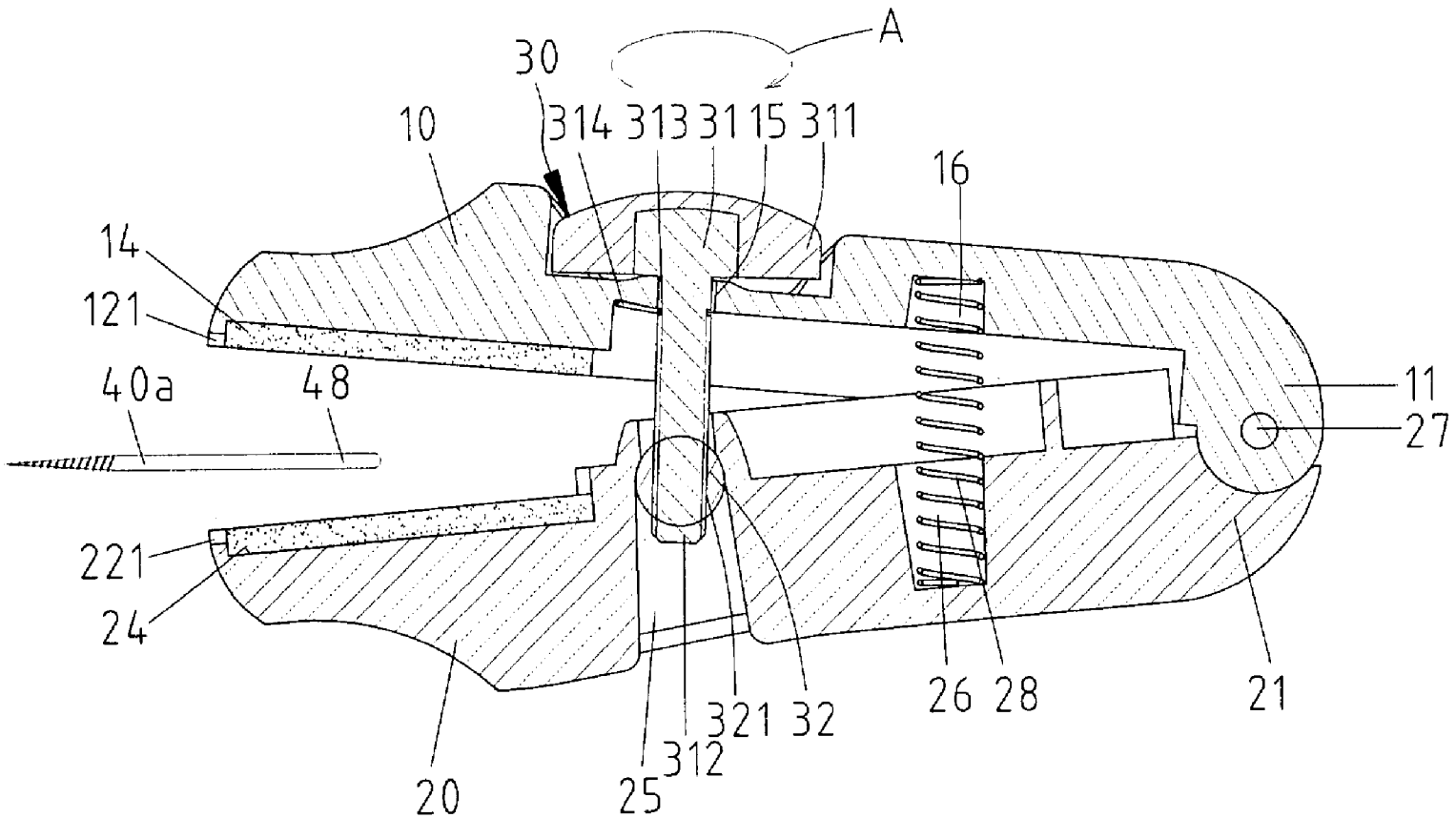
FIG. 4 is a sectional view similar to FIG. 3, wherein the hook screw driver is in an opened state.
Figure 5:
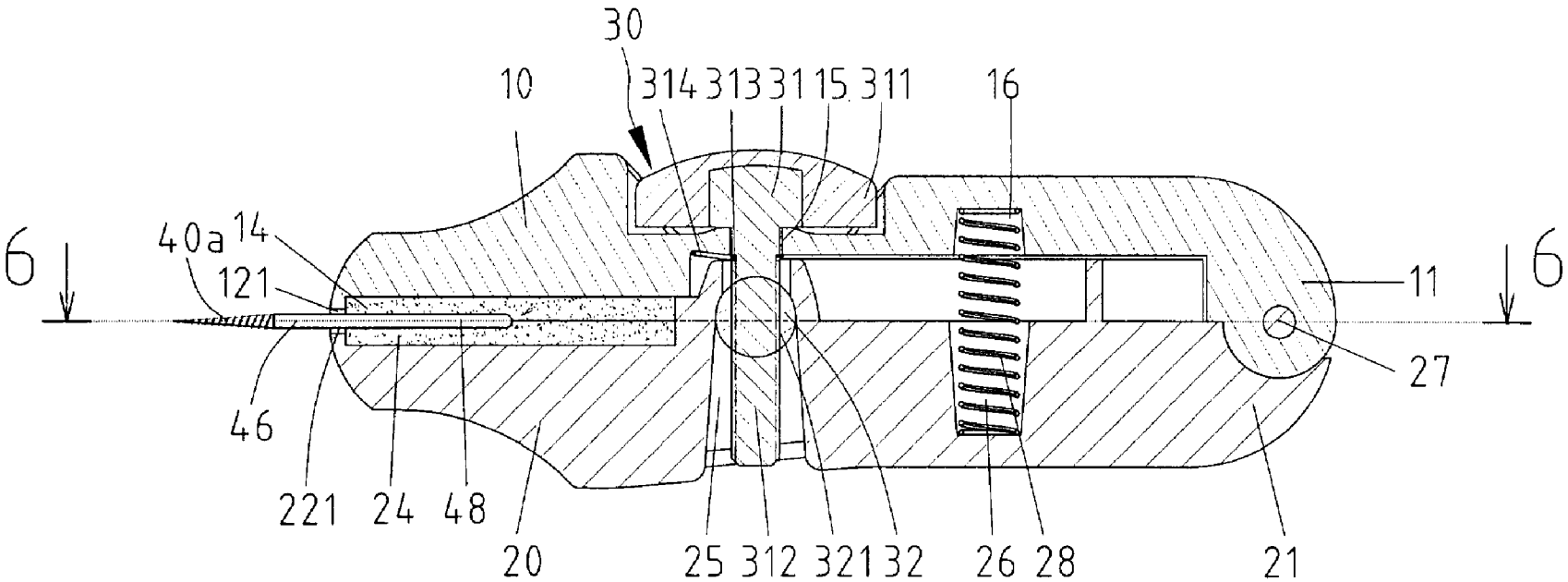
FIG. 5 is a sectional view similar to FIG. 4, wherein the hook screw driver is in a closed state to securely clamp a hook screw.
Figure 6:
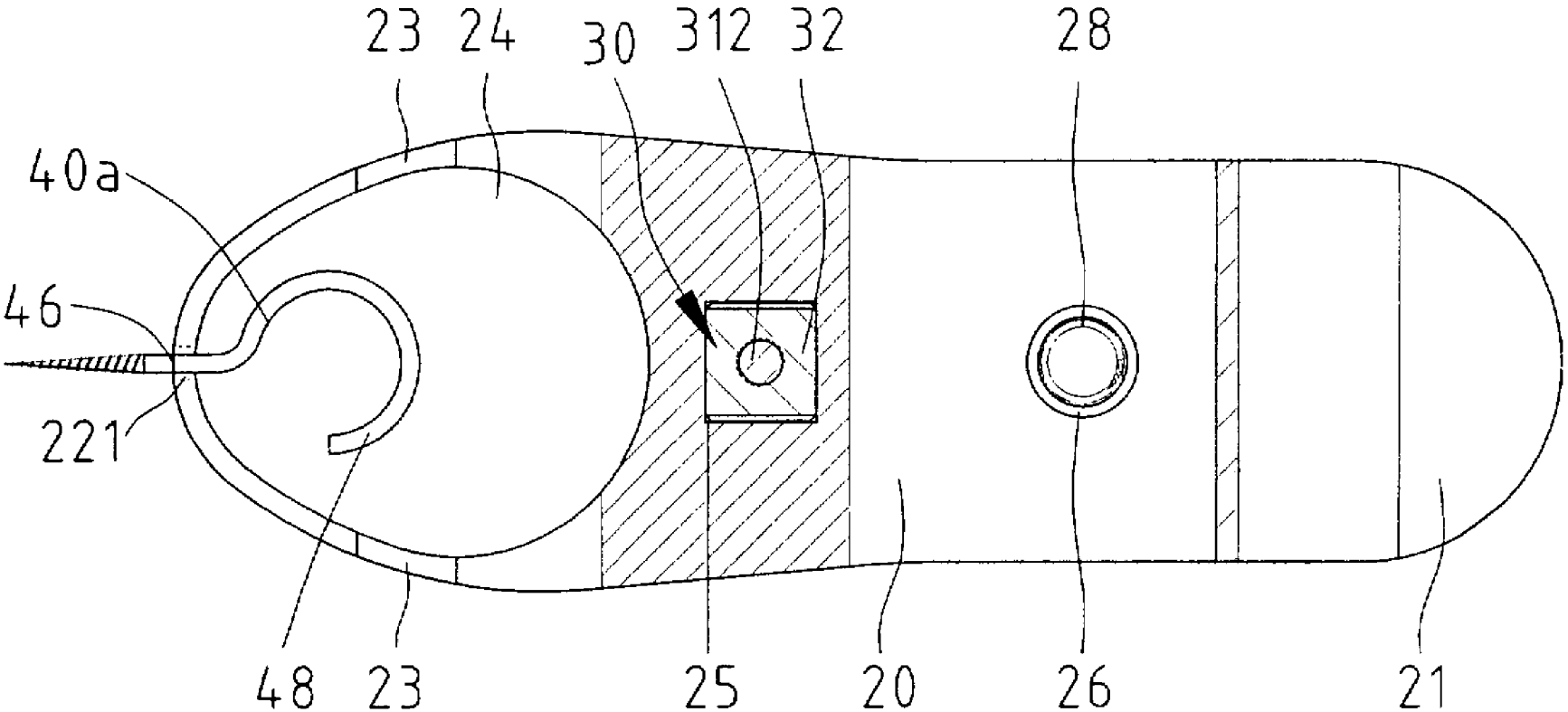
FIG. 6 is a sectional view taken along plane 6—6 in FIG. 5.

The hook screw driver in FIG. 3 is in a closed state, with the elastic element 28 compressed. When in use, the user turns the end piece 311 of the tightening member 30 and thus causes pivotal movement of the second end of the first body 10 away from the second end of the second body 20 under the action of the elastic element 28, as the threaded stem 312 of the tightening member 30 is in threading engagement with the screw hole 321 of the retaining member 32 that is fixed. Then, a hook portion 48 of a hook screw 40*a* is placed on the second holding member 24, with a straight portion 46 of the hook screw 40 extending beyond the second body 20 via the positioning hole 221 of the second body 20, as best shown in FIG. 6. Next, referring to FIG. 4, the user turns the end piece 311 of the tightening member 30 in a reverse direction (e.g., in the direction indicated by arrow A) to cause pivotal movement of the second end of the first body 10 toward the second end of the second body 20 until the second end of the first body 10 presses against the second end of the second body 20, as best shown in FIG. 5. Thus, the hook portion 48 of the hook screw 40*a* is securely held between the first holding member 14 and the second holding member 24. The first holding member 14 and the second holding member 24 made from highly deformable, highly frictional material assist in positioning of the hook screw 40*a* while driving the hook screw 40*a* into, e.g., a timber. It is noted that the straight portion 46 of the hook screw 40*a* also extends through the positioning hole 121 of the first body 10.

Figure 7:
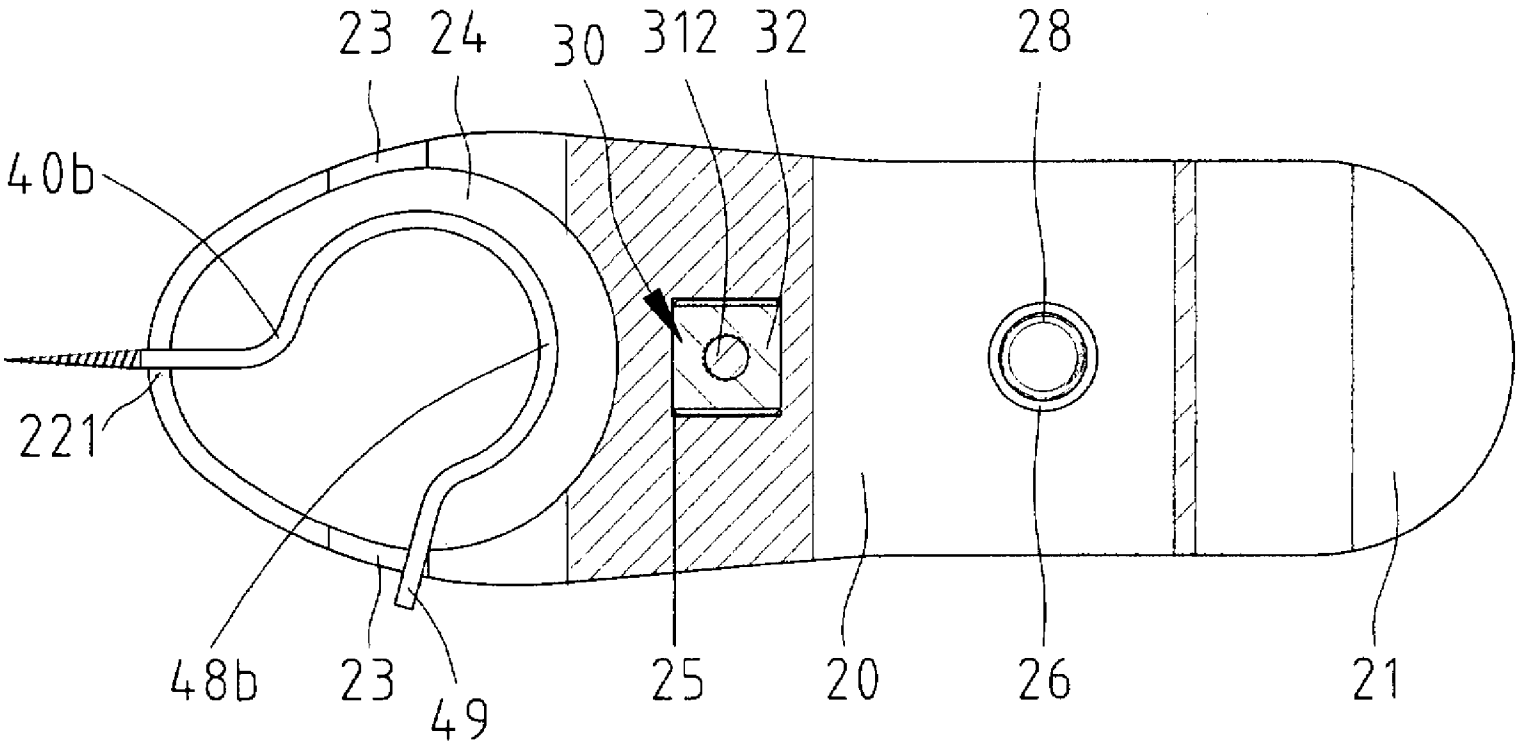
FIG. 7 is a sectional view similar to FIG. 6, illustrating use of the hook screw driver with a hook screw having a larger hook portion.
Figure 8:
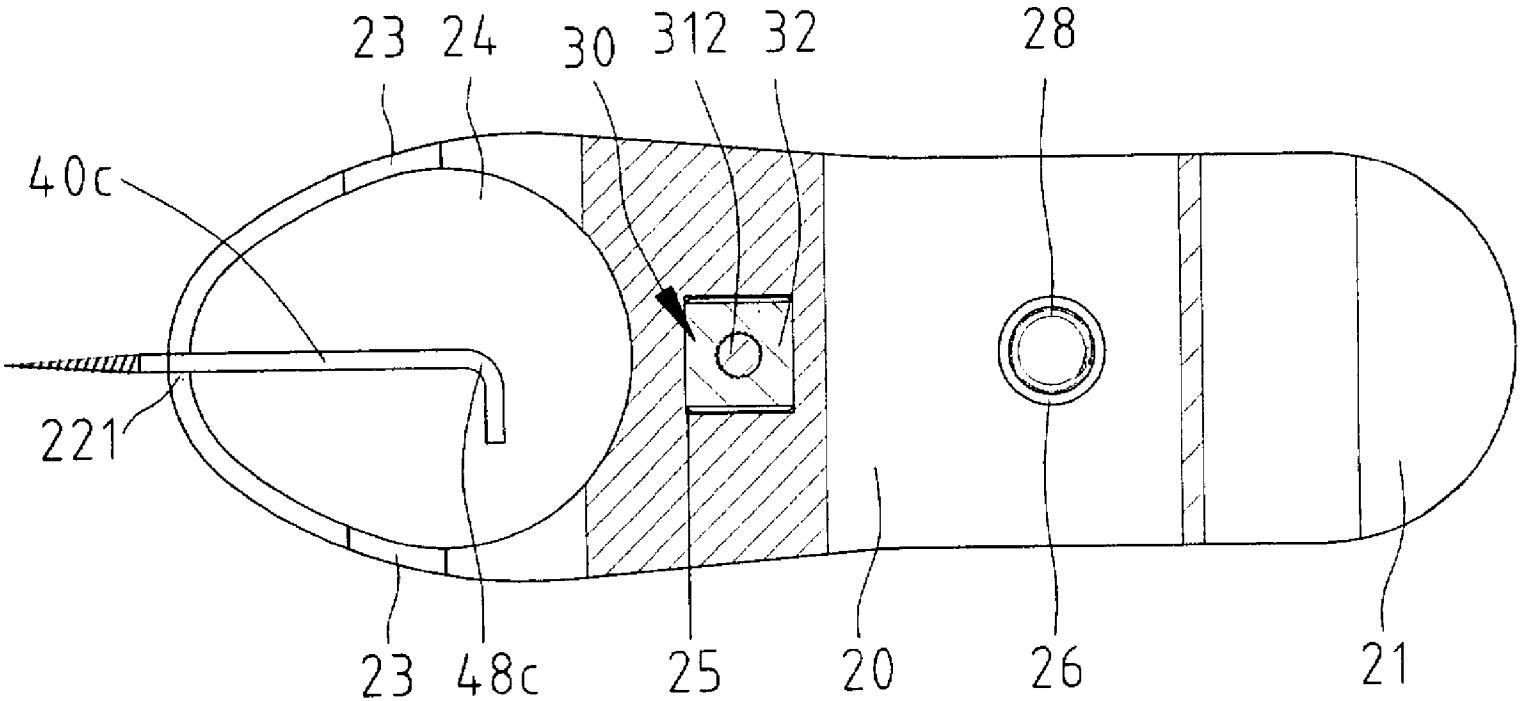
FIG. 8 is a sectional view similar to FIG. 6, illustrating use of the hook screw driver with a hook screw having an L-shaped hook portion.

FIG. 7 illustrates use of the hook screw driver with a hook screw (now designated by 40*b*) having a larger hook portion 48*b* having a distal end 49 retained in one of the notches 13 of the first body 10 and an associated one of the notches 23 of the second body 20. FIG. 8 illustrates use of the hook screw driver with a hook screw (now designated by 40*c*) having an L-shaped hook portion 48*c*. Thus, the hook screw driver of the present invention may be used with hook screws of various types and sizes.

Figure 9:
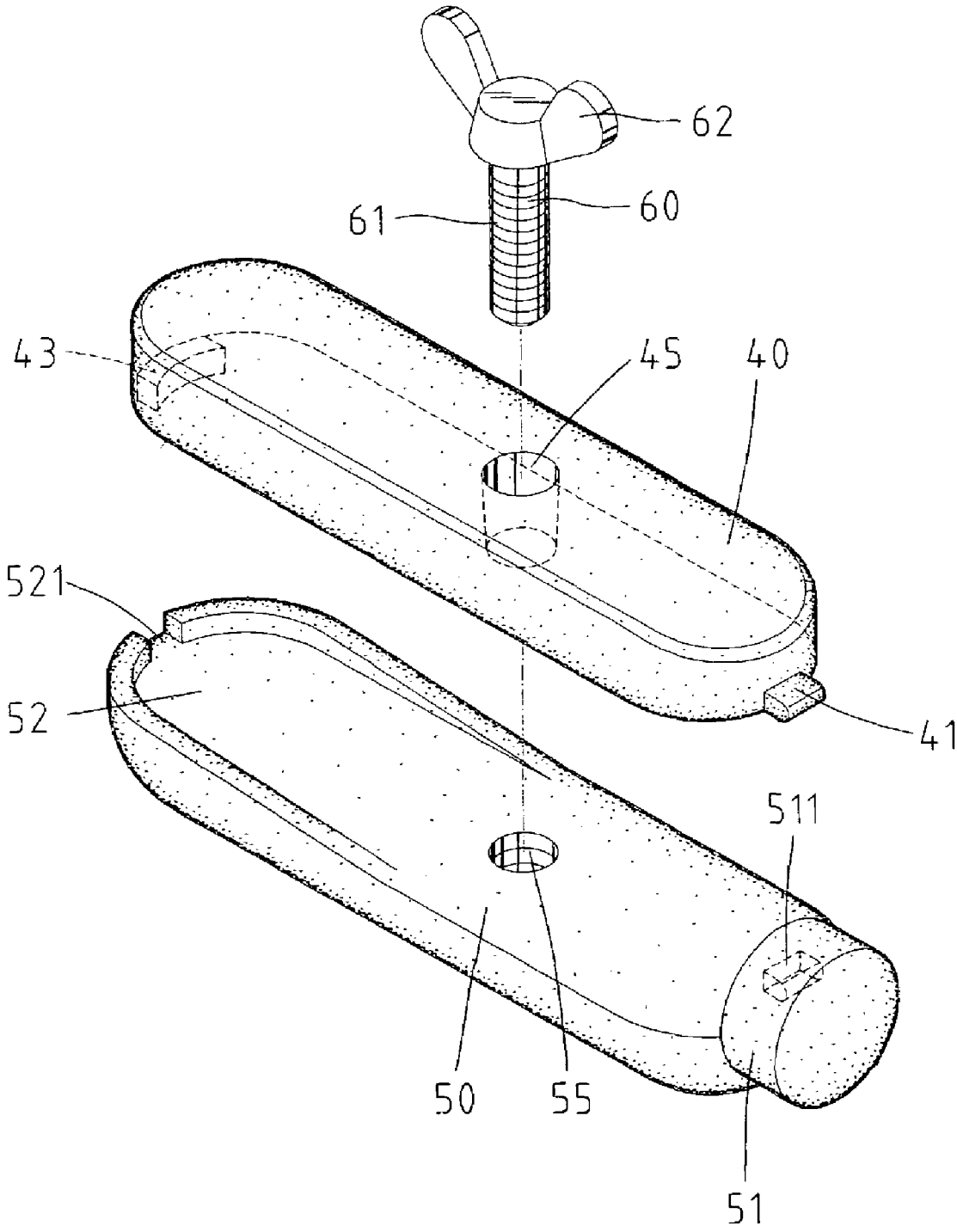
FIG. 9 is an exploded perspective view illustrating a second embodiment of the hook screw driver in accordance with the present invention.
Figure 10:
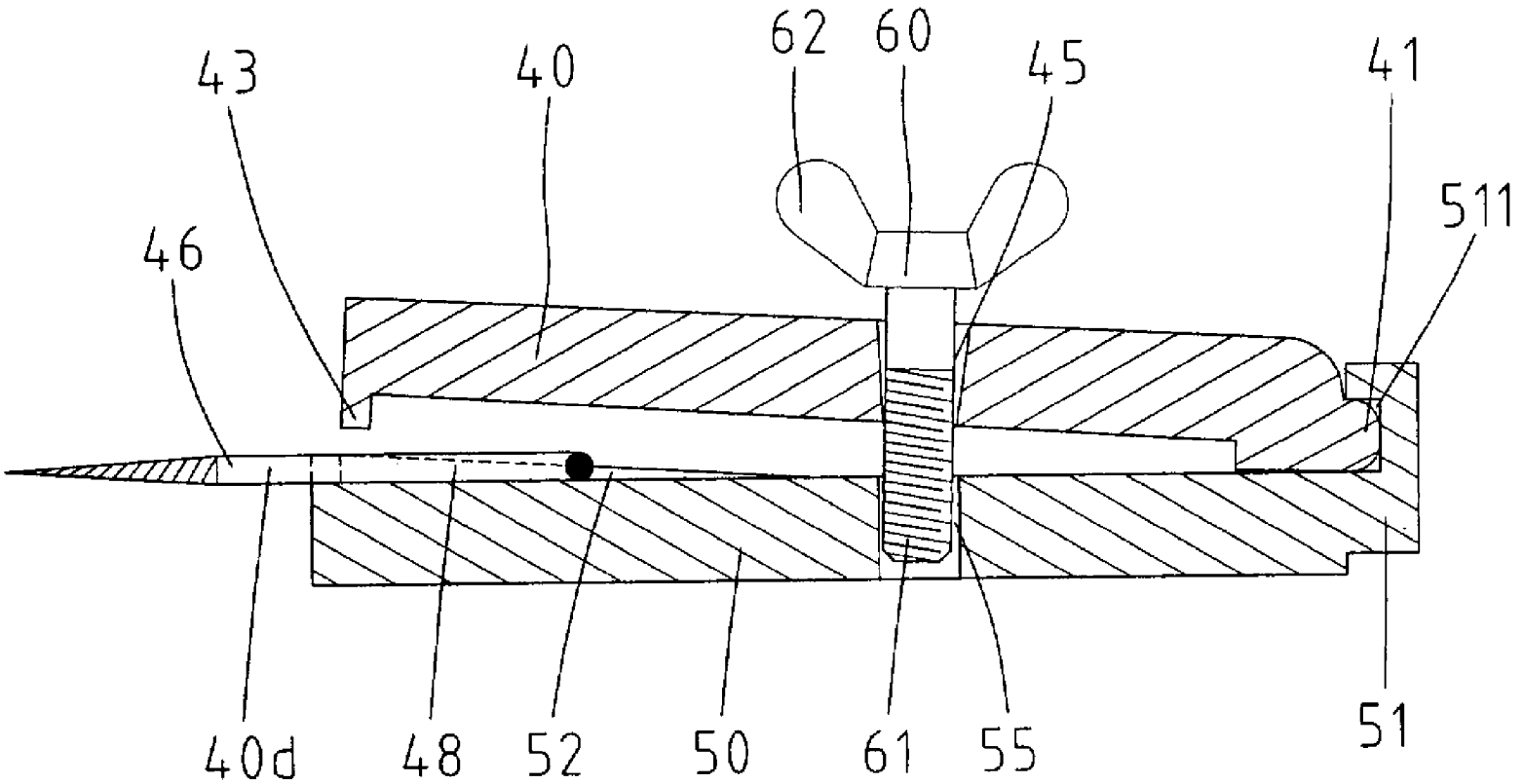
FIG. 10 is a sectional view of the hook screw driver in FIG. 9, wherein the hook screw driver is in an opened state.
Figure 11:
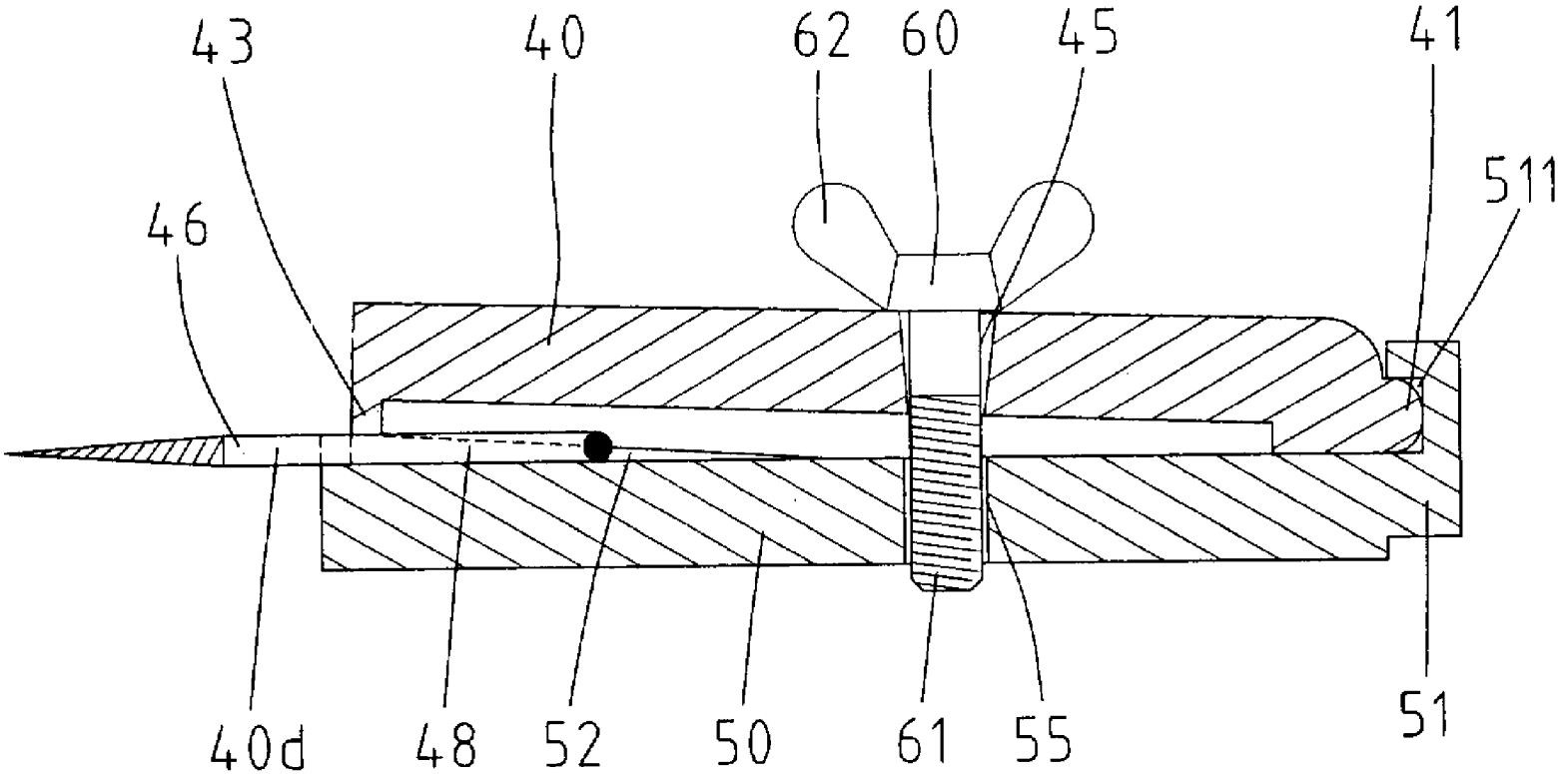
FIG. 11 is a sectional view similar to FIG. 10, wherein the hook screw driver is in a closed state.

FIGS. 9 through 11 illustrate a second embodiment of the hook screw driver in accordance with the present invention. In this embodiment, the hook screw driver includes a first body 40, a second body 50, and a tightening member 60. The first body 40 has a first end connected to a first end 51 of the second body 50. In this embodiment, the first end of the first body 40 has a protruded portion 41 that is pivotably received in a groove 511 in the first end 51 (in the form of a disc) of the second body 50. The first body 40 includes a pressing member 43 formed on a second end thereof and facing the second body 50. The second body 50 has a recessed portion 52 facing the first body 40, and a peripheral wall of the recessed portion 52 has a positioning hole 521. A through-hole 45 is defined in an intermediate portion of the first body 40 and extends in a direction substantially perpendicular to an extending direction of the first body 40. A threaded through-hole 55 is defined in an intermediate portion of the second body 50 and extends in a direction substantially perpendicular to an extending direction of the second body 50.

The tightening member 60 is in the form of a butterfly bolt and has a threaded stem 61 extending through the through-hole 45 of the first body 40 and the threaded through-hole 55 of the second body 50, with an end piece 62 of the tightening member 60 located outside the first body 40 for manual operation. Preferably, the end piece 62 has an outer diameter greater than a diameter of the through-hole 45 of the first body 40.

As illustrated in FIG. 10, the tightening member 60 can be turned in a direction and thus move upward to a position allowing the second end of the first body 40 to pivot away from the second end of the second body 50. Thus, a hook portion 48 of a hook screw 40*d* can be placed into the recessed portion 52 of the second end of the second body 50, with a straight portion 46 of the hook screw 40*d* extending beyond the second body 50 via the positioning hole 521. The tightening member 60 is then turned in a reverse direction to make the second end of the first body 40 pivot toward the second end of the second body 50 until the pressing member 43 of the first body 40 presses against the hook screw 40*d*, as best shown in FIG. 11. Thus, the hook screw 40*d* is securely held between the second end of the first body 40 and the second end of the second body 50.

Figure 12:
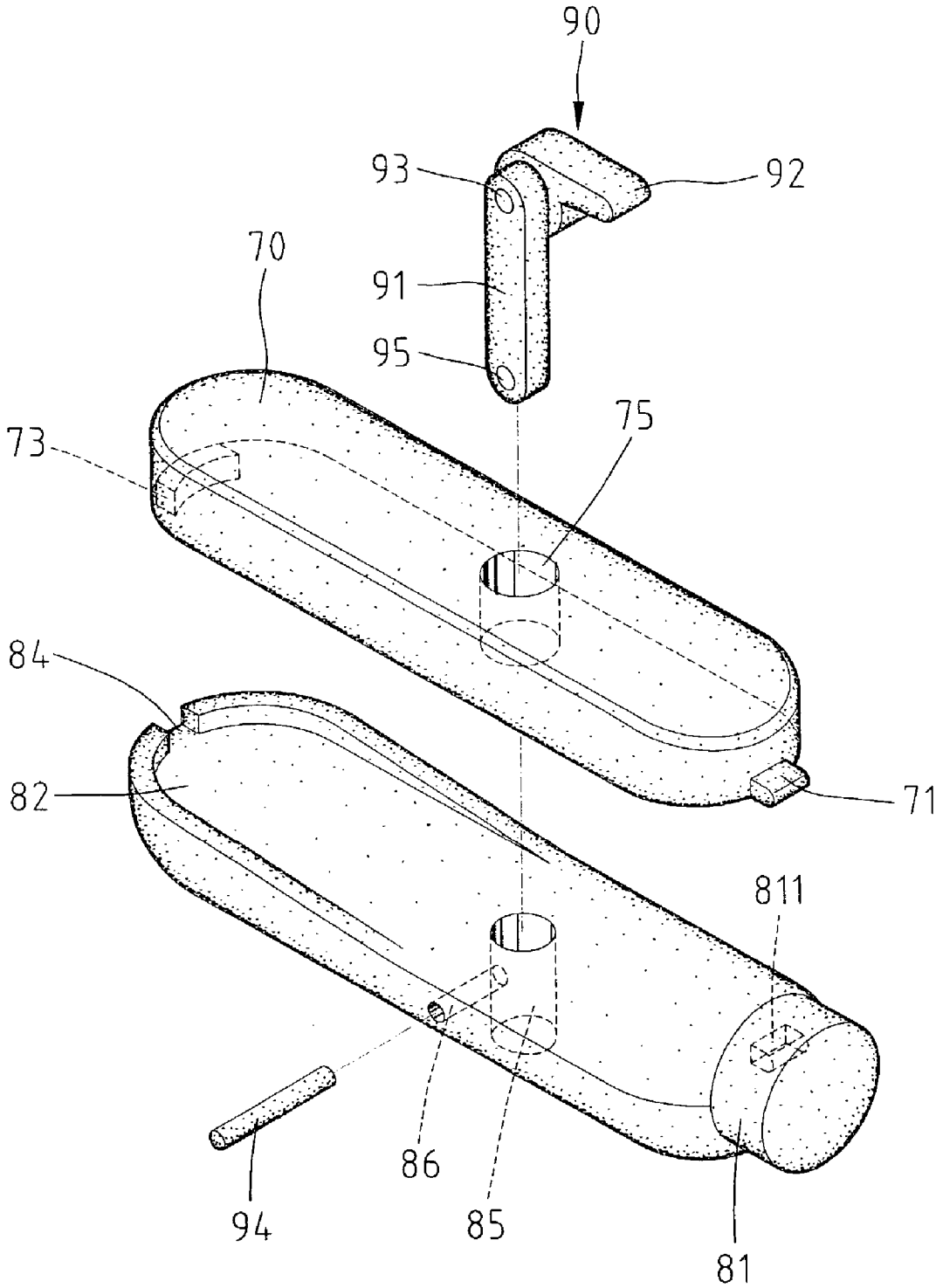
FIG. 12 is an exploded perspective view illustrating a third embodiment of the hook screw driver in accordance with the present invention.
Figure 13:
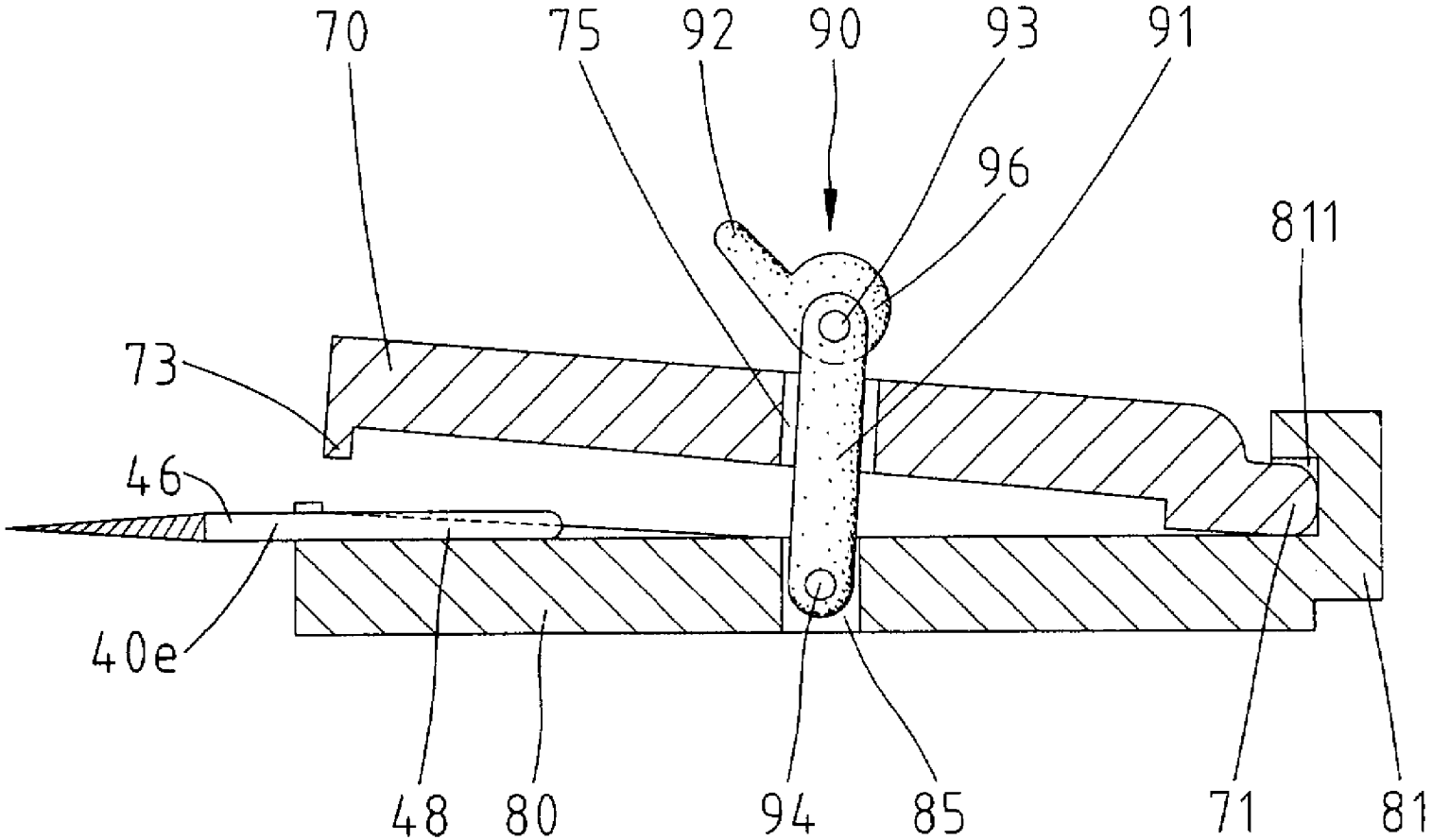
FIG. 13 is a sectional view of the hook screw driver in FIG. 12, wherein the hook screw driver is in an opened state.
Figure 14:
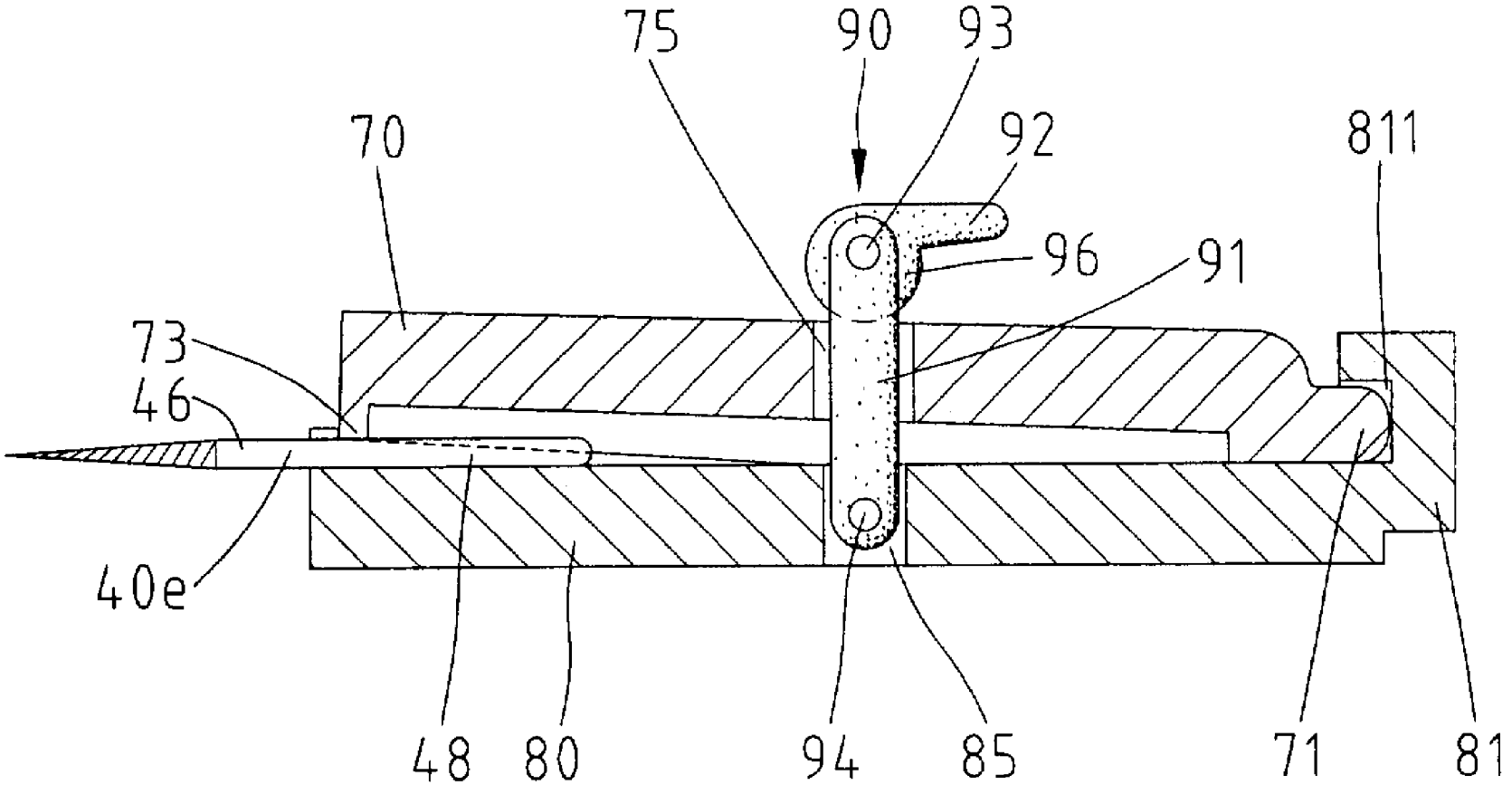
FIG. 14 is a sectional view similar to FIG. 13, wherein the hook screw driver is in a closed state.

FIGS. 12 through 14 illustrate a third embodiment of the hook screw driver in accordance with the present invention. In this embodiment, the hook screw driver includes a first body 70, a second body 80, and a tightening member 90. The first body 70 has a first end connected to a first end 81 of the second body 80. In this embodiment, the first end of the first body 70 has a protruded portion 71 that is pivotably received in a groove 811 in the first end 81 (in the form of a disc) of the second body 80. The first body 70 includes a pressing member 73 on a second end thereof. The second body 80 has a recessed portion 82. and a peripheral wall of the recessed portion 82 has a positioning hole 84. A through-hole 75 is defined in an intermediate portion of the first body 70 and extends in a direction substantially perpendicular to an extending direction of the first body 70. A hole 85 is defined in an intermediate portion of the second body 80 and extends in a direction substantially perpendicular to an extending direction of the second body 80.

The tightening member 90 includes a rod 91 that extends through the through-hole 75 of the first body 70, with a lower end 95 of the rod 91 fixed by a peg 94 that extends through a transverse hole 86 in the second body 80 into the hole 85 of the second body 80, and with an upper end of the rod 91 located outside the first body 70 for manual operation. A turn piece 92 has a lobe 96 pivotally and eccentrically connected by a pin 93 to the upper end of the rod 91 Preferably, the turn piece 92 has an outer diameter greater than a diameter of the through-hole 75 of the first body 70.

The tightening member 90 can be pivoted to a position shown in FIG. 13, allowing the second end of the first body 70 to pivot away from the second end of the second body 80. Thus, a hook portion 48 of a hook screw 40*e* can be placed into the recessed portion 82 of the second end of the second body 80. The tightening member 90 is then pivoted in a reverse direction. The lobe 96 of the tightening member 90 urges the second end of the first body 70 to pivot toward the second end of the second body 80 until the pressing member 73 of the first body 70 presses against the hook screw 40*e*, as best shown in FIG. 14. Thus, the hook screw 40*e* is securely held between the second end of the first body 70 and the second end of the second body 80.

Although the invention has been explained in relation to its preferred embodiments, it is to be understood that many other possible modifications and variations can be made without departing from the scope of the invention as hereinafter claimed.

What is claimed is:

1. A hook screw driver comprising:

a first body having a first end and a second end;

a second body having a first end and a second end, the first end of the first body being connected to and pivotable relative to the first end of the second body, allowing the second end of the first body to move toward and away from the second end of the body; and a tightening member extending along a direction substantially perpendicular to an extending direction of the first body and an extending direction of the second body, the tightening member being movable between a first position at which the second end of the first body is spaced from the second end of the second body and a second position at which the second end of the first body presses against the first end of the second body, thereby securely holding a hook portion of a hook screw placed between the second end of the first body and the second end of the second body, with the first body having a underside parallel to the extending direction of the first body, with the second body having a top side parallel to the extending direction of the second body, with the underside and top side of the first and second bodies abutting in the second position, with one of the underside and top side of the first and second bodies including a projection extending in the extending direction and the other of the underside and top side of the first and second bodies including a socket extending in the extending direction, with the socket having a size for slideable receipt and abutment of the projection in the first and second positions, with the first body having a through-hole in an intermediate portion thereof, with the second body having a through-hole in an intermediate portion thereof, with a retaining member mounted in the through-hole of the second body and having a screw hole, with the retaining member being cylindrical in shape having circular cross sections, with the screw hole extending radially of the circular cross sections, with the retaining member located in the projection, with the tightening member including a threaded stem extending through the through-hole of the first body, the socket, and the screw hole of the retaining member, with an end of the threaded stem located outside the first body, with an end piece mounted to the threaded stem for manual operation, with the end piece having a diameter greater than a diameter of the through-hole of the first body, with the first body including a top side having an indentation for receiving the end piece, with the indentation having an extent generally equal to that of the end piece.

2. The hook screw driver as claimed in claim 1, with a first holding member being mounted in the underside of the second end of the first body, and with a second holding member being mounted in the top side of the second end of the second body, with the first holding member and the second holding member being made of deformable, frictional material for securely holding the hook portion of the hook screw.

3. The hook screw driver as claimed in claim 1, wherein the through-hole of the second body has a portion that tapers from a side of the second body facing away from the first body to another side of the second body facing the first body.

4. The hook screw driver as claimed in claim 1, with the second body including a recessed portion having a positioning hole through which a straight portion of the hook screw extends.

5. The hook screw driver as claimed in claim 1, with the second end of the first body including a recessed portion having a positioning hole through which a straight portion of the hook screw extends, and with the second end of the second body including a recessed portion having a positioning hole through which the straight portion of the hook screw extends.

6. The hook screw driver as claimed in claim 5, with a first holding member being mounted in the recessed portion of the first body, and with a second holding member being mounted in the recessed portion of the second body, the first holding member and the second holding member being made of deformable, frictional material for securely holding the hook portion of the hook screw.

7. The hook screw driver as claimed in claim 1, with the first body including a recessed portion having a positioning hole through which a straight portion of the hook screw extends, and with the second body including a recessed portion having a positioning hole through which the straight portion of the hook screw extends.

8. The hook screw driver as claimed in claim 7, with a first holding member being mounted in the recessed portion of the first body, and with a second holding member being mounted in the recessed portion of the second body, the first holding member and the second holding member being made of deformable, frictional material for securely holding the hook portion of the hook screw.

9. A hook screw driver comprising:

a first body having a first end and a second end;

a second body having a first end and a second end, the first end of the first body being connected to and pivotable relative to the first end of the second body, allowing the second end of the first body to move toward and away from the second end of the body; and a tightening member extending alone a direction substantially perpendicular to an extending direction of the first body and an extending direction of the second body, the tightening member being movable between a first position at which the second end of the first body is spaced from the second end of the second body and a second position at which the second end of the first body presses against the first end of the second body, thereby securely holding a hook portion of a hook screw placed between the second end of the first body and the second end of the second body, with the first body having a underside parallel to the extending direction of the first body, with the second body having a top side parallel to the extending direction of the second body, with the underside and top side of the first and second bodies abutting in the second position, with one of the underside and top side of the first and second bodies including a projection extending in the extending direction and the other of the underside and top side of the first and second bodies including a socket extending in the extending direction, with the socket having a size for slideable receipt and abutment of the projection in the first and second positions, with the first body having a receptacle defined in the underside thereof facing the second body and in one of the projection and socket, with the second body having a receptacle defined in the top side thereof facing the first body and in the other of the projection and socket, and with an elastic element having two ends respectively received in the receptacle of the first body and the receptacle of the second body for biasing the second end of the first body away from the second end of the second body.

10. The hook screw driver as claimed in claim 9, with the first body including a recessed portion having a positioning hole through which a straight portion of the hook screw extends, and with the second body including a recessed portion having a positioning hole through which the straight portion of the hook screw extends.

11. The hook screw driver as claimed in claim 10, with a first holding member being mounted in the recessed portion of the first body, and with a second holding member being mounted in the recessed portion of the second body, the first holding member and the second holding member being made of deformable, frictional material for securely holding the hook portion of the hook screw.

12. A hook screw driver comprising:

a first body having a first end and a second end;

a second body having a first end and a second end, the first end of the first body being connected to and pivotable relative to the first end of the second body, allowing the second end of the first body to move toward and away from the second end of the body; and a tightening member extending alone a direction substantially perpendicular to an extending direction of the first body and an extending direction of the second body, the tightening member being movable between a first position at which the second end of the first body is spaced from the second end of the second body and a second position at which the second end of the first body presses against the first end of the second body, thereby securely holding a hook portion of a hook screw placed between the second end of the first body and the second end of the second body, with the second end of the first body including a recessed portion having a positioning hole through which a straight portion of the hook screw extends, and with the second end of the second body including a recessed portion having a positioning hole through which the straight portion of the hook screw extends, with the recessed portion of the second body further having at least one notch through which a distal end of the hook portion of the hook screw extends, with the recessed portion of the first body further having at least one notch through which the distal end of the hook portion of the hook screw extends.

13. A hook screw driver comprising:

a first body having a first end and a second end;

a second body having a first end and a second end, the first end of the first body being connected to and pivotable relative to the first end of the second body, allowing the second end of the first body to move toward and away from the second end of the body; and a tightening member extending along a direction substantially perpendicular to an extending direction of the first body and an extending direction of the second body, the tightening member being movable between a first position at which the second end of the first body is spaced from the second end of the second body and a second position at which the second end of the first body presses against the first end of the second body, thereby securely holding a hook portion of a hook screw placed between the second end of the first body and the second end of the second body, with the first body having a underside parallel to the extending direction of the first body, with the second body having a top side parallel to the extending direction of the second body, with the underside and top side of the first and second bodies abutting in the second position, with one of the underside and top side of the first and second bodies including a projection extending in the extending direction and the other of the underside and top side of the first and second bodies including a socket extending in the extending direction, with the socket having a size for slideable receipt and abutment of the projection in the first and second positions, with the first body having a through-hole in an intermediate portion thereof, and with the second body having a screw hole in an intermediate portion thereof, with the tightening member including a threaded stem extending through the screw hole of the second body, with an end of the threaded stem located outside the first body, with an end piece mounted to the threaded stem for manual operation, with the end piece having a diameter greater than a diameter of the through-hole of the first body, with the first body including a top side having an indentation for receiving the end piece, with the indentation having an extent generally equal to that of the end piece.

14. The hook screw driver as claimed in claim 13, with the end of the threaded stem having a diameter grater than a diameter of the through-hole of the first body.

15. A hook screw driver comprising:

a first body having a first end and a second end;

a second body having a first end and a second end, the first end of the first body being connected to and pivotable relative to the first end of the second body, allowing the second end of the first body to move toward and away from the second end of the body; and a tightening member extending along a direction substantially perpendicular to an extending direction of the first body and an extending direction of the second body, the tightening member being movable between a first position at which the second end of the first body is spaced from the second end of the second body and a second position at which the second end of the first body presses against the first end of the second body, thereby securely holding a hook portion of a hook screw placed between the second end of the first body and the second end of the second body, with the first body having a underside parallel to the extending direction of the first body, with the second body having a top side parallel to the extending direction of the second body, with the underside and top side of the first and second bodies abutting in the second position, with one of the underside and top side of the first and second bodies including a projection extending in the extending direction and the other of the underside and top side of the first and second bodies including a socket extending in the extending direction, with the socket having a size for slideable receipt and abutment of the projection in the first and second positions, with the first body having a through-hole in an intermediate portion thereof, and with the second body having a through-hole in an intermediate portion thereof, with a retaining member mounted in the through-hole of the second body and having a screw hole, with the retaining member being cylindrical in shape having circular cross sections, with the screw hole extending radially of the circular cross sections, with the retaining member located in the projection, with the tighening member including a threaded stem extending through the through-hole of the body, the socket, and the screw hole of the retaining member.

16. The hook screw driver as claimed in claim 15, with the retaining member located above the top side of the second body.

* * * * *